United States Patent [19]

Flumm et al.

[11] 4,037,398

[45] July 26, 1977

[54] DIGITAL TIMER AND TIME INDICATOR DRUMS THEREFOR

[75] Inventors: Paul T. Flumm, Oakville; Vernon B. Harris, Waterbury, both of Conn.

[73] Assignee: Robertshaw Controls Company, Richmond, Va.

[21] Appl. No.: 580,598

[22] Filed: May 27, 1975

Related U.S. Application Data

[62] Division of Ser. No. 465,707, April 30, 1974, Pat. No. 3,899,872.

[51] Int. Cl.[2] ..... G04F 3/02; G04F 3/04; G04C 23/12

[52] U.S. Cl. ..... 58/22.9; 58/21.13; 58/21.14; 58/33; 58/125 C; 235/1 C

[58] Field of Search ..... 58/21.13, 38, 39.5, 58/145, 125 C, 21.14, 33; 340/41, 43, 309.2, 323; 235/1 C

[56] References Cited

U.S. PATENT DOCUMENTS

| | | | |
|---|---|---|---|
| 2,091,146 | 8/1937 | Hamilton | 58/127 R |
| 2,170,408 | 8/1939 | Hillcourt | 58/6 |
| 2,459,107 | 1/1949 | Johnson | 58/16 R |
| 2,535,484 | 12/1950 | Conroy | 58/145 R |
| 2,645,896 | 7/1953 | Uhlig et al. | 58/125 C |
| 2,748,560 | 6/1956 | Clark | 58/125 C |
| 3,077,729 | 2/1963 | Schlenker | 58/127 R |
| 3,117,412 | 1/1964 | Malone | 58/127 R X |
| 3,603,073 | 9/1971 | Terada et al. | 58/50 R |
| 3,611,705 | 10/1971 | Niznik | 58/125 C |
| 3,618,644 | 11/1971 | Adler et al. | 58/143 |
| 3,807,167 | 4/1974 | Chappatte | 58/125 C |
| 3,827,232 | 8/1974 | Basset | 58/21.13 |
| 3,883,968 | 5/1975 | Suzuki | 58/125 C |

FOREIGN PATENT DOCUMENTS

| | | | |
|---|---|---|---|
| 1,110,446 | 2/1956 | France | 58/143 |

*Primary Examiner*—E. S. Jackmon
*Attorney, Agent, or Firm*—Candor, Candor & Tassone

[57] ABSTRACT

A digital timer having a selector to set a selected period of time that the timer is to be operated by the drive motor for only that set period of time, the timer comprising a pair of indicator drums rotatably mounted to the timer frame by a shaft. The drums have a pinion gear disposed therebetween and operatively associated therewith so that one of the drums will cause incremental movement of the other drum in a timed relation to incremental movement of that one drum caused by a drive connection of that one drum to the timer motor.

8 Claims, 14 Drawing Figures

DIGITAL TIMER AND TIME INDICATOR DRUMS THEREFOR

This application is a divisional patent application of its co-pending parent application Ser. No. 465,707, filed Apr. 30, 1974, now U.S. Pat. No. 3,899,872.

This invention relates to an improved digital timer and to improved time indicator drums for such a timer or the like.

Digital timers of both minute timing arrangement and cooking hours timing arrangement for a range timer are fully disclosed and claimed in applicants' copending patent applications, Ser. Nos. 390,118, and 390,024, both filed Aug. 20, 1973 and now respectively U.S. Pat. Nos. 3,930,359 and 3,857,234.

It is a feature of this invention to provide time indicating drums or wheels that can be utilized with such drive means of the digital timers disclosed in such aforementioned patent application.

In particular, one embodiment of this invention provides a pair of indicating drums rotatably mounted to the timer frame by a shaft means with a pinion gear means rotatably mounted to the frame means and disposed intermediate the indicating drums and cooperating therewith so that one of the drums will cause incremental movement of the other drum in a timed relation to incremental movement of that one drum when the same is interconnected to the drive means of the timer arrangement. The drive means of the timer arrangement includes a pinion gear that meshes with driven means of that one indicating drum that comprises a plurality of pins extending in a circular array from that one drum substantially parallel to the axis of rotation thereof.

Accordingly, it is an object of this invention to provide an improved digital timer having one or more of the novel features set forth above or hereinafter shown or described.

Another object of this invention is to provide an improved indicating drum arrangement for such a timer or the like, the indicating drum arrangement of this invention having one or more of the novel features set forth above or hereinafter shown or described.

Other objects, uses and advantages of this invention are apparent from a reading of this description, which proceeds with reference to the accompanying drawings forming a part thereof and wherein.

Figure 1:
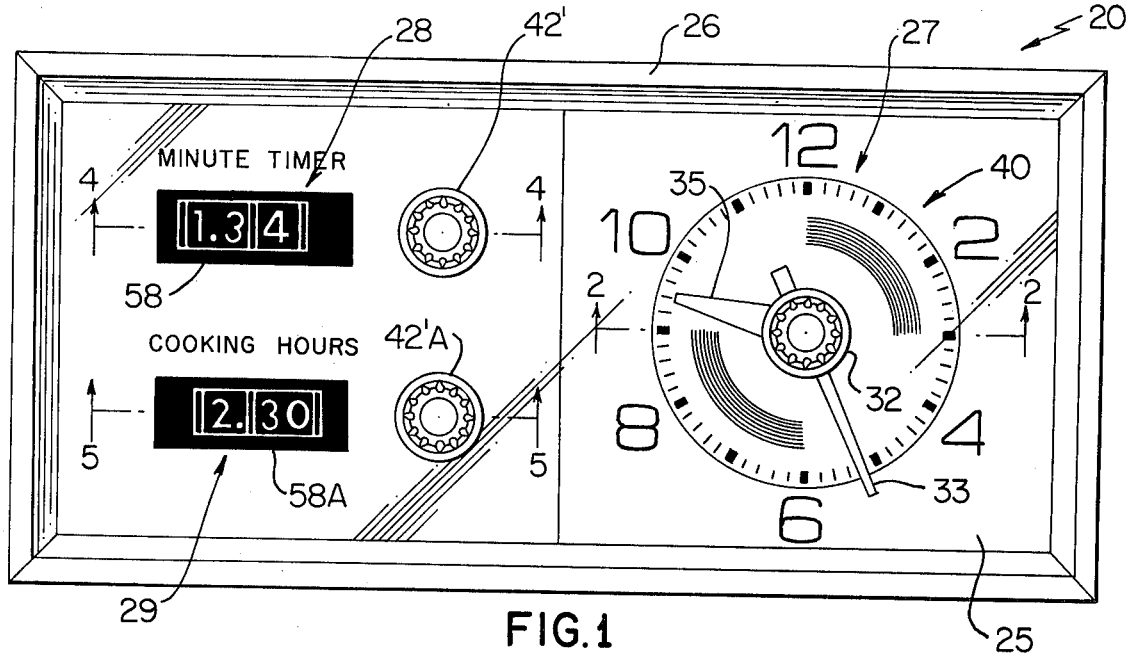
FIG. 1 is a front view of the improved digital timer of this invention utilized as a cooking range timer.

While the various features of this invention are hereinafter illustrated and described as being particularly adaptable to provide a range timer, it is to be understood that the various features of this invention can be utilized singly or in any combination thereof to provide digital timer means for other apparatus as desired.

Therefore, this invention is not to be limited to only the embodiments illustrated in the drawings, because the drawings are merely utilized to illustrate one of the wide variety of uses of this invention.

Figure 2:
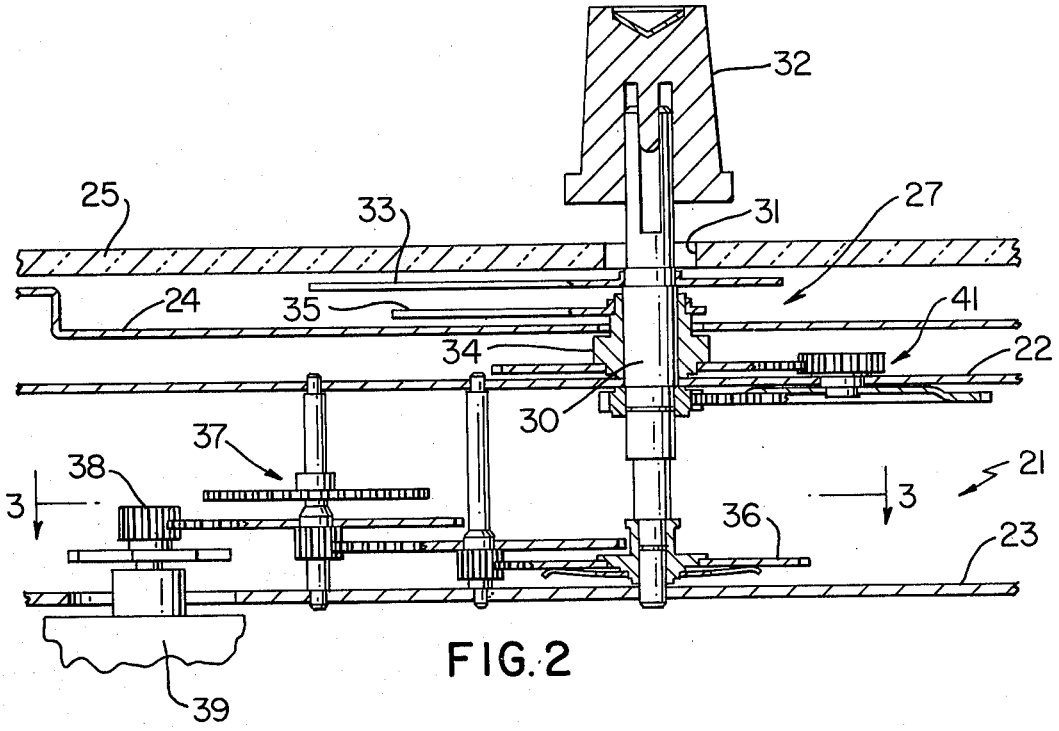
FIG. 2 is an enlarged, fragmentary, cross-sectional view taken on line 2—2 of FIG. 1 and illustrates the clock mechanism of the range timer of FIG. 1.

Referring now to FIG. 1, the improved digital timer of this invention is generally indicated by the reference numeral 20 and comprises a frame means that is generally indicated by the reference numeral 21 in FIG. 2 and formed from a pair of spaced apart frame plates 22 and 23 carrying a dial and indicating plate 24 disposed behind a glass panel 25 bordered by a frame trim 26 as illustrated in FIG. 1.

The range timer 20 includes a time-of-day clock means that is generally indicated by the reference numeral 27, a minute digital timer means that is generally indicated by the reference numeral 28 and a cooking hours digital timer means that is generally indicated by the reference numeral 29.

The time-of-day clock means 27 is best illustrated in FIG. 2 and comprises a selector shaft 30 rotatably mounted in the frame plates 22 and 23 and projecting out of an opening 31 in the glass cover 25 to carry a selector knob 32 on the outer end thereof, the selector shaft 30 having a minute hand 33 fastened thereto and having a bushing 34 rotatably mounted thereon and carrying the hour hand 35. The shaft 30 has a gear 36 on the lower end thereof which is adapted to be driven by a gear train that is generally indicated by the reference numeral 37 in FIG. 2 and is interconnected to an output drive pinion 38 of an electrical drive motor 39 so that when the timer motor 39 is operating, the same continuously drives the shaft 30 in a proper direction at the proper rate whereby the hands 33 and 35 thereof indicate the time of day in relation to a dial face that is generally indicated by the reference numeral 40 in FIG. 1 and provided on the front plate 24 in a conventional manner, the rotating shaft 30 driving the hour bushing 34 through a gear train arrangement that is generally indicated by the reference numeral 41 in FIG. 2.

Since the details of the parts and the operation of the clock 27 by the timer motor 39 as well as for the drive from the timer motor 39 to digital timer indicating means is fully disclosed and described in the aforementioned copending patent applications, such copending patent applications are incorporated herein by reference and thereby the full details of the drive arrangement from the drive motor 39 to operate the clock 27 and the digital timer means 28 and 29 need not be described as the same is not necessary to understand the novel features of this invention as such drive means does not form a feature of this invention. However, it is believed that sufficient details of such drive means will be hereinafter set forth to fully understand the novel features of this invention.

Nevertheless, if one desires a more detailed description of the structure and operation of the drive means for the digital timer means 28 and 29 and the time-of-day clock means 27, reference can be made to the description of such structure and operation in the aforementioned copending patent applications.

Figure 4:
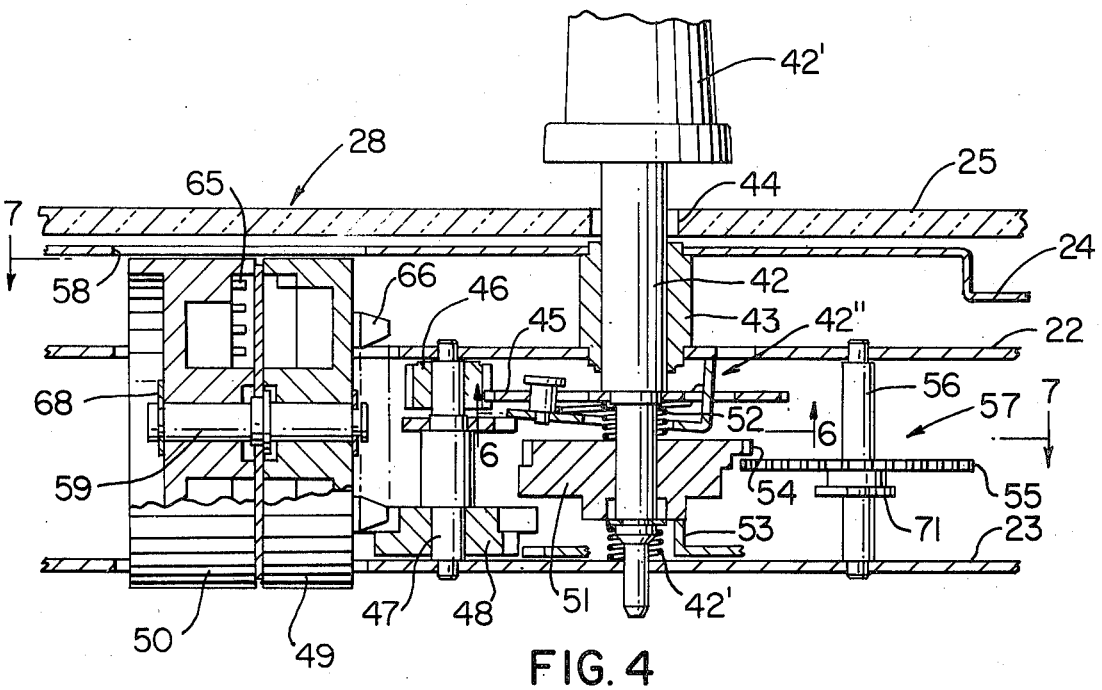
FIG. 4 is an enlarged, fragmentary, cross-sectional view taken on line 4—4 of FIG. 1 and illustrates the minute digital timer arrangement of the range timer of FIG. 1.

As illustrated in FIG. 4, the minute digital timer means 28 includes a selector shaft 42 rotatably mounted by bushing means 43 to the frame plate 22 and front plate 24 while projecting out of an opening 44 in the glass cover 25 so that a selector knob 42' can be fastened to the outer end thereof. The shaft 42 carries a gear 45 which is disposed in meshing relation with a pinion gear 46 fastened to a shaft 47 which is rotatably mounted between the frame plates 22 and 23. The shaft 47 carries a gear 48 that is adapted to drive a pair of time indicating drums 49 and 50 in a manner hereinafter described when the gear 48 is rotated either by the selector shaft 42 being rotated by the operator to select a period of time that the timer means 28 is to operate or by the gear 48 being rotated by the timer motor 39 when a driving gear dog 51 is disposed in meshing relation with the gear 48.

Figure 7:
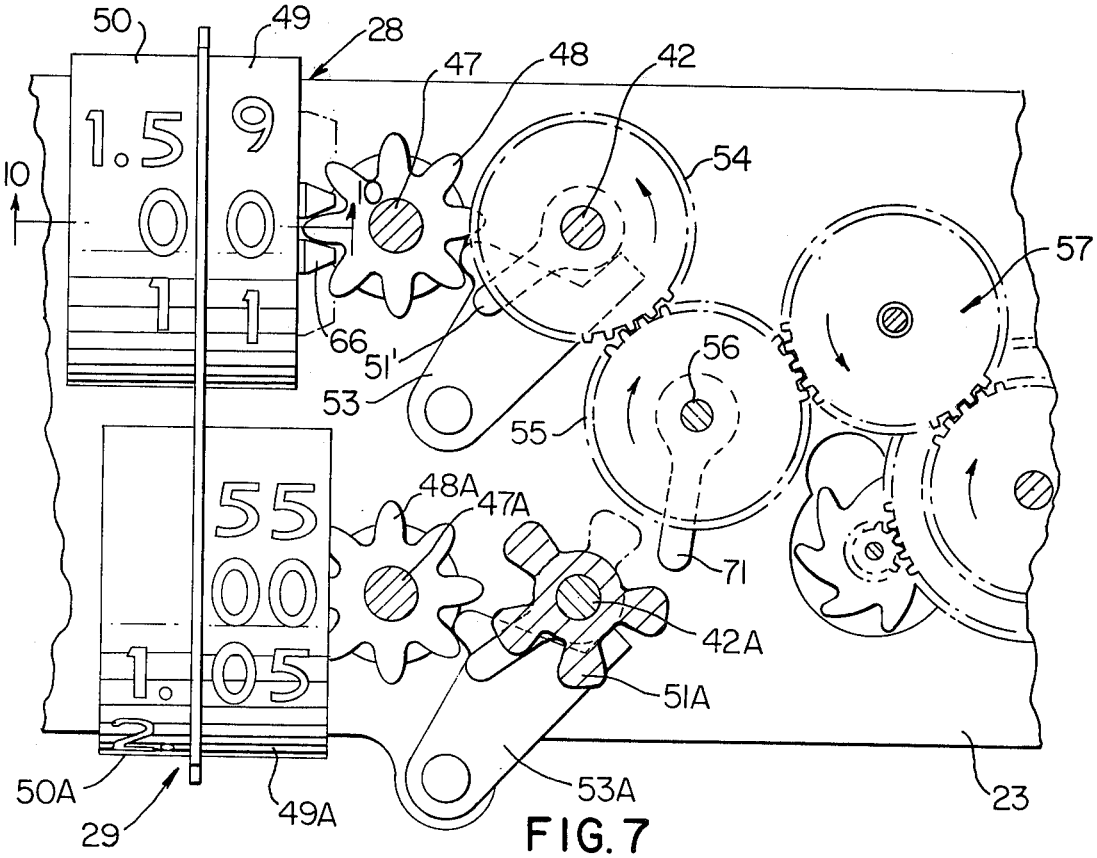
FIG. 7 is a fragmentary, cross-sectional view taken substantially in the direction of the arrows 7—7 of FIG. 4.
Figure 3:
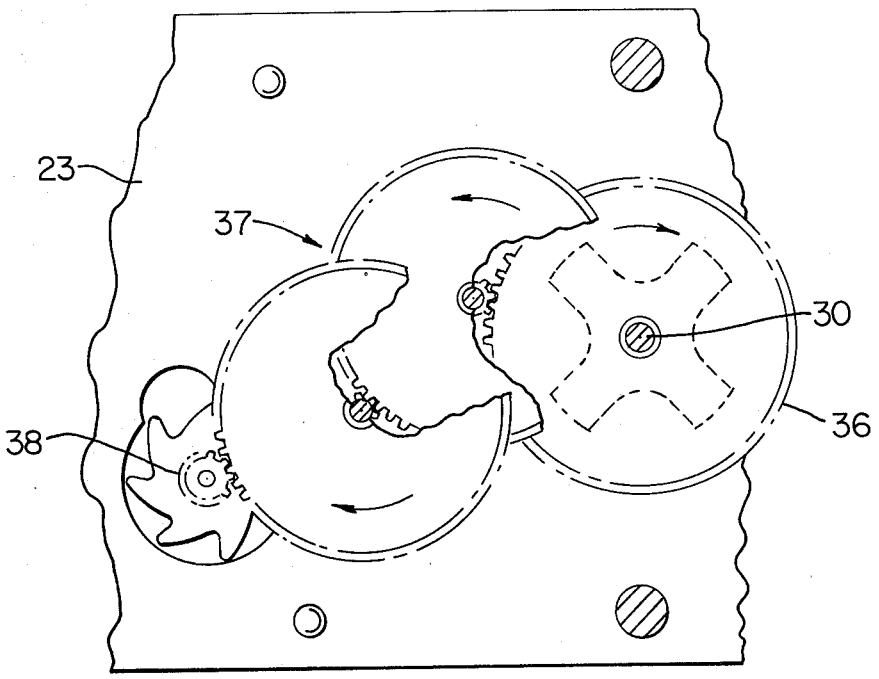
FIG. 3 is a fragmentary, cross-sectional view taken on line 3—3 of FIG. 2.

In particular, the driving gear dog 51 is loosely mounted on the selector shaft 42 and is normally urged downwardly into meshing relation with the gear 48 by a compression spring 52. However, when the digital timer means 28 is in the zero or time run out position thereof, a latch member 53 holds the driving dog gear 51 in a raised condition as illustrated in FIG. 4 so that the driving dog means 51 not only is not in meshing relation with the gear 48, but also a gear portion 54 of the driving gear dog 51 is out of meshing relation with a gear 55 that is fixed to a shaft 56 rotatably mounted between the frame plate 22 and 23 and disposed in meshing relation with a gear train that is generally indicated by the reference numeral 57 in FIG. 7 and directly driven by the pinion gear 38 of the timer motor 39.

However, when the selector knob 42' is rotated in a direction to select a period of time that will be indicated by the indicating drums 49 and 50 at the window area 58 formed in the front plate 24, such rotation of the shaft 42 moves the latch member 53 away from the driving gear dog 51 so that the compression spring 52 can move the driving gear dog 51 down into meshing relation with the gear 48 as well as into meshing relation with the gear 55. Thus, the timer motor 39 will cause rotation of the driving gear dog 51 and, thus, rotation of the gear 48 which causes incremental movement of the indicating drums 49 and 50 from the time set position thereof back to their zero position and when such zero or time run out position is reached, the driving dog 51 is moved upwardly in FIG. 4 by a spring 42' as latch means 42'' is now moved to an unlatching position thereof to disengage the dog 51 from the gear 48 and the gear 55 so that the indicating drums 49 and 50 will remain in their zero position until again set in a time position by the selector shaft 42 as previously described, the latch means 53 being moved back into latching position with the dog 51 by the member 48.

Figure 9:
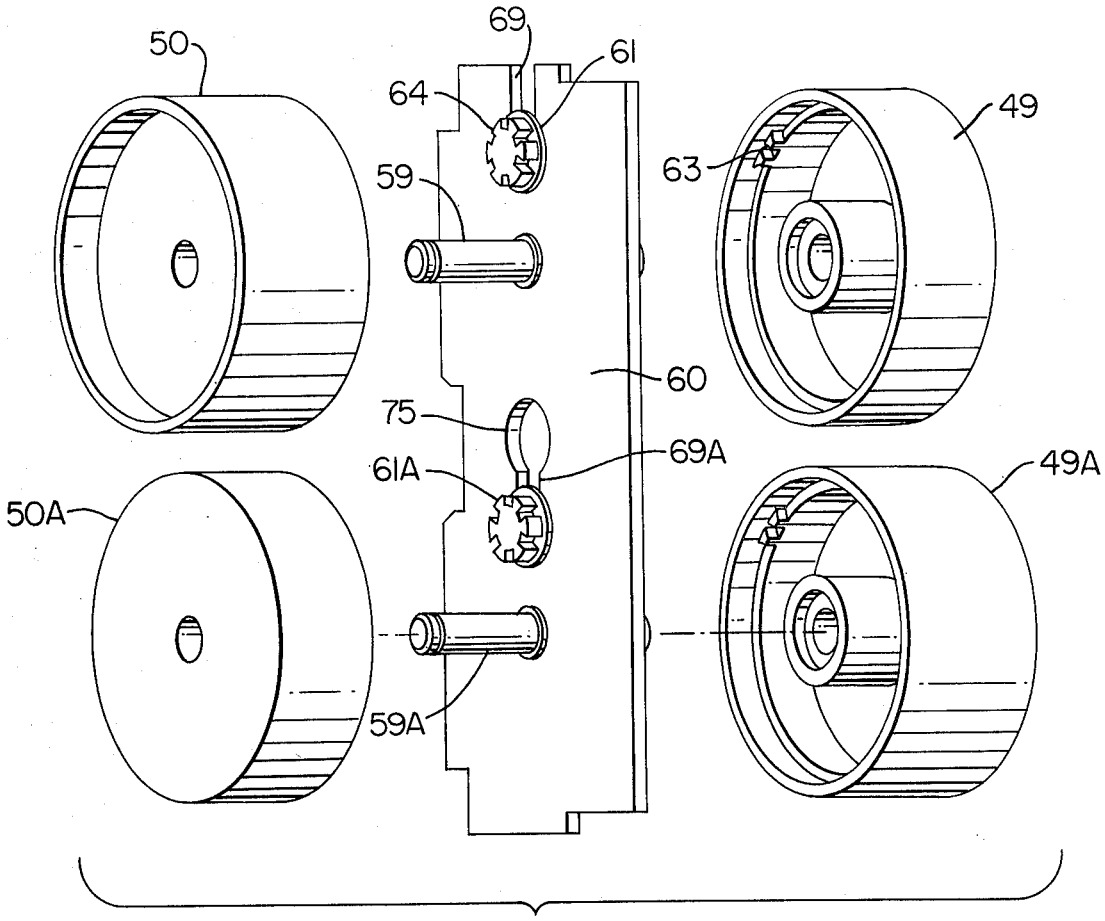
FIG. 9 is a view similar to FIG. 8 and illustrates in exploded perspective view of the other side of the indicating drum arrangement of FIG. 8.
Figure 6A:
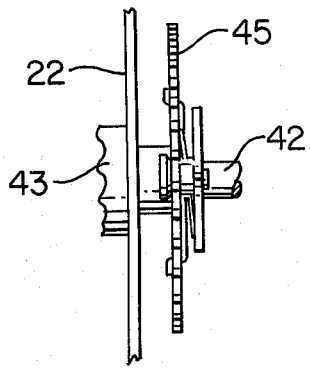
FIG. 6A is a fragmentary, left-hand side view of the structure illustrated in FIG. 6 and is taken substantially in the direction of the arrows 6A—6A of FIG. 6.
Figure 6:
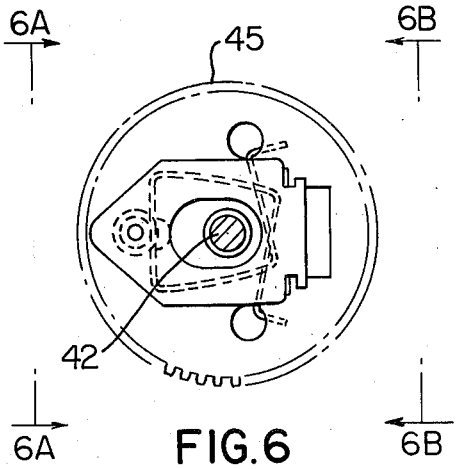
FIG. 6 is a fragmentary, cross-sectional view taken on line 6—6 of FIG. 4.
Figure 6B:
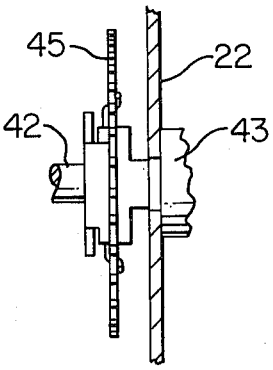
FIG. 6B is a fragmentary, right-hand side view of the structure illustrated in FIG. 6 and is taken substantially in the direction of the arrows 6B—6B of FIG. 6.
Figure 8:
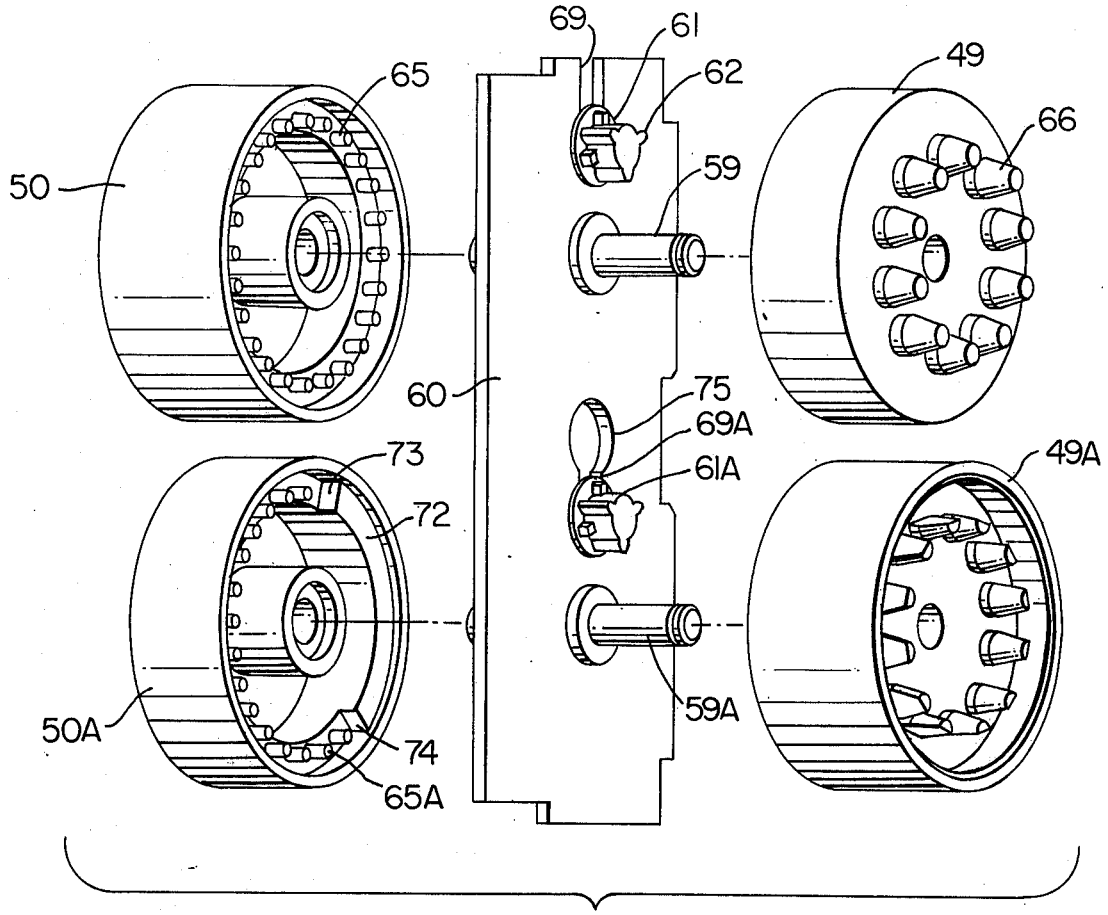
FIG. 8 is an exploded side perspective view of the time indicating drum arrangement of the digital timer means of FIG. 1.
Figure 11:
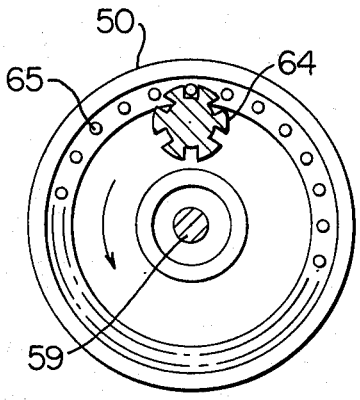
FIG. 11 is a cross-sectional view taken on line 11—11 of FIG. 10.
Figure 10:
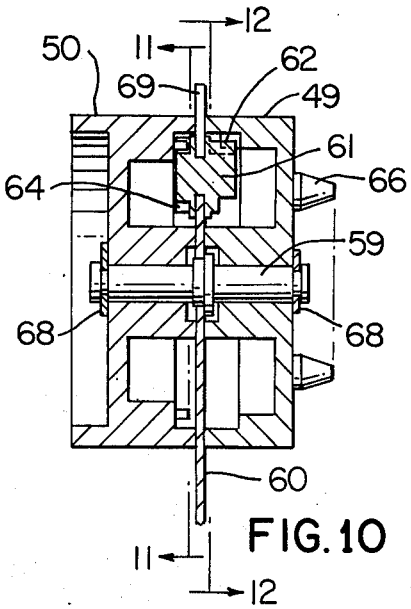
FIG. 10 is a cross-sectional view taken on line 10—10 of FIG. 7 and illustrating the indicating drum arrangement for the minute timer means of the range timer of FIG. 1.
Figure 12:
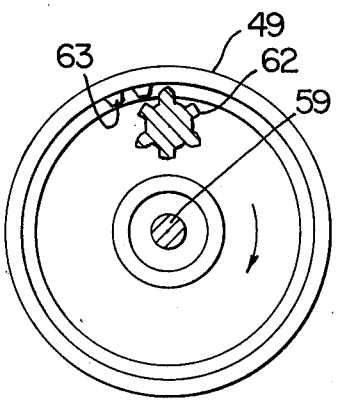
FIG. 12 is a cross-sectional view taken on line 12—12 of FIG. 10.

The indicating drums 49 and 50 are respectively rotatably mounted on a single shaft 59, FIGS. 8, 9 and 10 carried by a frame plate 60 mounted transversely to the frame plates 22 and 23 whereby the indicating drums 49 and 50 are disposed on opposite sides of the frame plate 60 as illustrated in FIG. 10.

A pinion gear member 61 is rotatably mounted to the frame plate 60 and has a gear part 62 that cooperates with a ring gear means 63 of the indicating drum 49 to be rotated thereby at a certain rate as the drum 49 is rotated by the gear 48 previously described. The pinion gear member 61 has another gear part 64 that cooperates with a plurlity of pins 65 that are disposed in a circular array on the indicating drum 50 and extend substantially parallel to the axis of rotation of the indicating drum 50 while being concentric therewith so that as the gear member 61 rotates, the same rotates the indicating drum 50 at the proper rate.

The indicating drum 49 has a plurality of pins 66 extending from the side 67 thereof and disposed in a circular array concentric to the shaft 59 and substantially parallel to the axis of rotation of the drum 49 so as to be disposed in meshing relation with the drive gear 48 as illustrated in FIG. 4.

The drums 49 and 50 are respectively held on the shaft 59 after initially being telescoped thereon by suitable C-shaped retainers 68 carried by the shaft 59 as illustrated in FIGS. 4 and 10. Therefore, it can be seen that the indicating drums 49 and 50 can be easily mounted to the shaft 59 of the frame plate 60 and the pinion gear 61 for providing the incremental drive therebetween can be easily assembled to the frame plate 60 by being slipped down a slot 69 formed therein and be held in place by the cooperating gear means 63 and 65 of the indicating drums 49 and 50.

The operation of the minute digital timer means 28 will now be described.

When the operator desires to utilize the minute digital timer means 28 to time an operation for a particular period of time, such as for one hour and thirty four minutes as illustrated in FIG. 1, the operator grasps the selector knob 42' and rotates the selector shaft 42 in the desired direction so that the gear 45 through its meshing relation with its gear 46 turns the shaft 47 and, thus, the gear 48 to act on the pins 66 of the indicator drum 49 to rotate the indicator drum 49. As the indicator drum 49 is thus rotated, the ring gear 63 thereof will cause the pinion member 61 to cause rotation of the drum 50 until the desired time period is indicated at the window 58 at which time the operator releases the selector knob 42'.

As previously stated, while the selector knob 42' is being rotated to set the time period at the window 58, the latch member 53 is moved away from the driving gear dog 51 and the driving gear dog 51 is moved downwardly by the compression spring 52 to place the gear portion 54 thereof in meshing relation with the gear 55 so that the driving gear dog 51 is now interconnected to the drive pinion gear 38 of the drive motor 39. Rotation of the driving gear dog 51 now begins and the driving tooth 51' thereof incrementally drives the gear 48 each time the driving gear dog 51 makes a complete revolution and such movement of the gear 48 acts through the pins 66 of the indicating drum 49 to incrementally drive the drum 49 and, thus, through the proper time relation of the pinion gear 61 drives the indicating drum 50 back toward the zero position thereof. When such zero or time run out position is reached by the drums 49 and 50 to indicate that the previously preset time period has now lapsed, the driving gear dog 51 is moved upwardly in opposition to the force of the compression spring 52 to the position illustrated in FIG. 4 by the spring 42' as the latch means 42" is moved to an unlatching position thereof whereby the driving gear dog 51 is out of meshing relation with the gear 48 and the gear 55 so that the indicating drums 49 and 50 remain in their zero indicating positions until the operator again selects a time period in the manner previously described, the latch means 53 being moved back into latching position with the dog 51 by the member 48.

The cooking hours digital timer means 29 is similar to the minute digital timer means 28 previously described except that a longer period of time can be selected for the timer means 29. Thus, parts of the timer means 29 that are similar to the timer means 28 previously described are indicated by like reference numerals followed by the letter "A".

Figure 5:
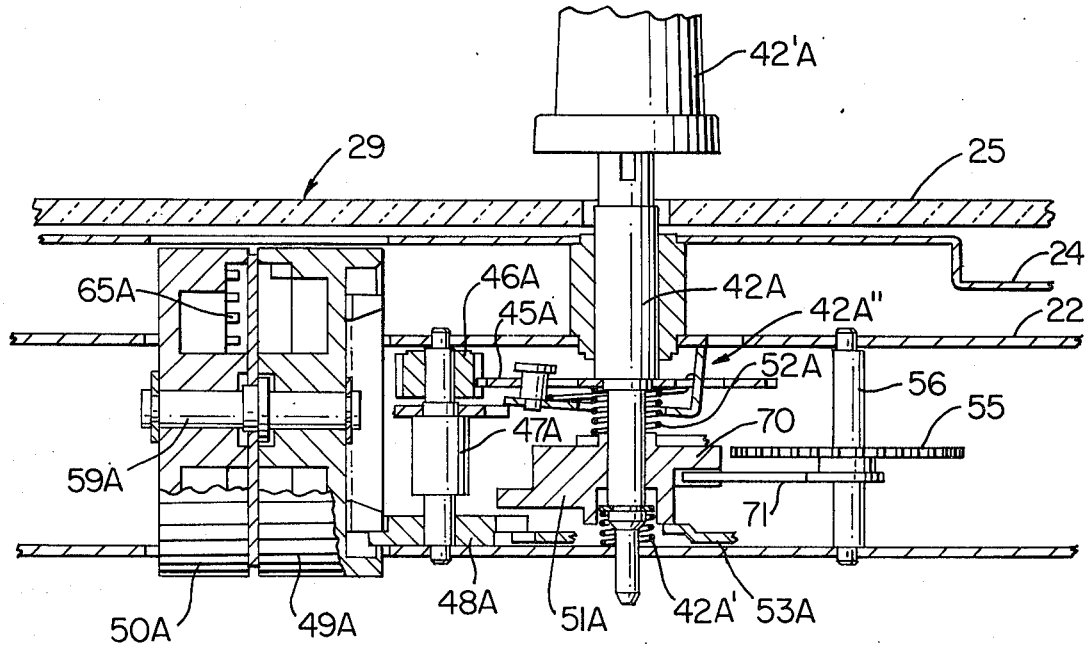
FIG. 5 is an enlarged, fragmentary, cross-sectional view taken on line 5—5 of FIG. 1 and illustrates the cooking hours digital timer arrangement of the range timer of FIG. 1.

Referring now to FIG. 5, the digital timer means 29 includes the selector shaft 42A having the selector knob 42'A on the outer end thereof for driving through the gear 45A, pinion gear 46A, shaft 47A and gear 48A the time indicating drums 49A and 50A which are rotatably mounted on a single shaft 59A carried by the frame plate 60 for time selection purposes.

However, the drum 49A of the timer means 29 has time indicating minutes from zero to fifty-five minutes disposed thereon in increments of five minutes whereas the drum 49 of the timer means 28 merely has the minutes indicated thereon from zero to nine in increments of one.

Likewise, the drum 50A of the timer means 29 has hours indicated thereon in increments of one whereas the drum 50 of the timer means 28 had hours disposed thereon in increments of ones as well as the tens of minutes disposed thereon in increments of ten.

The driving dog 51A of the selector shaft 42A of the timer means 29 has a gear portion 70 adapted to be disposed in meshing relation with a driving dog 71 carried by the shaft 56 below the gear 55 thereof when the driving dog 51A is adapted to be moved downwardly by the force of the compression spring 52A when the latch member 53A is moved away from the driving dog 51A so that the driving dog 71 will incrementally drive the driving dog 51A which, in turn, will incrementally drive the drive gear 48A for the indicating drums 49A and 50A.

If it is desired to limit the amount of time that can be selected for the timer means 29, the pins 65A of the indicating drum 50A need not extend in a complete circular array so that an unpinned portion 72 of the indicator drum 50A will provide stop means 73 and 74 at the opposed ends thereof to prevent further movement of the drum 50A by the pinion gear member 61A at those extreme limits of the drum 50A.

As illustrated in FIGS. 8 and 9, it can be seen that the pinion gear member 61A can readily be assembled to the frame plate 60 by first being disposed in an enlarged opening 75 formed through the plate 60 before the same is slipped down into a cooperating slot means 69A for rotatably mounting the pinion gear member 61A to the plate 60.

Since the operation of the digital cooking hour timer means 29 is identical to the operation of the digital minute timer means 28 previously described except that the indicating means 49A and 50A present a different appearance of time relation at the window 58A thereof as illustrated in FIG. 1, the operation of the cooking hour timer means 29 need not be described as the same has the period of time thereof set by the selector knob 42'A thereof in the same manner as the timer 28 and the indicating drums 49A and 50A are then driven back to the zero or time run out position thereof by the timer motor 39 in the manner previously described as the gear 48A is incrementally moved under the drive of the drive motor 39.

Also, it is to be fully understood from the aforementioned copending patent applications, that the timer means 29 will operate a cooking apparatus to cook an item for the time period that is selected at the window 58A thereof by the selector knob 42'A whereas the timer means 28 can operate a light switch or bell at the end of the selected time period thereof for timing purposes if desired.

Therefore, it can be seen that this invention not only provides an improved digital timer means, but also this invention provides improved digital time indicating drum means for such a timer means or the like.

While the form of the invention now preferred has been illustrated and described as required by the Patent Statute, it is to be understood that other forms can be utilized and still come within the scope of the appended claims.

What is claimed is:

1. In a digital timer having timer means carried by a frame means and setting means to set a selected period of time of said timer means operatively associated with means for interconnecting drive means and said timer means together to cause said drive means to drive said timer means for only said set period of time, said timer means comprising shaft means carried by said frame means and a pair of indicator drums rotatably mounted to said frame means by said shaft means, said drums having means cooperating together so that one of said drums will cause incremental movement of the other drum in a timed relation to incremental movement of said one drum, said cooperating means comprising a pinion-like gear means rotatably mounted to said frame means intermediate said drums, said one drum having drive means operatively associated with said gear means to drive the same as said one drum is rotated, said other drum having driven means operatively associated with said gear means to be driven thereby in a timed relation to the incremental movement of said one drum, the improvement wherein said driven means of said other drum comprises a plurality of pins extending in a circular array from said other drum substantially parallel to the axis of rotation of said other drum, said one drum having driven means to be driven by the first-mentioned drive means when interconnected thereto, said driven means of said one drum comprising a plurality of pins extending in a circular array from said one drum substantially parallel to the axis of rotation of said one drum, said first-mentioned drive means that drives said pins of said one drum comprising a gear rotatably mounted to said frame means to rotate about an axis substantially transverse to said axis of rotation of said one drum and meshing with certain of said pins.

2. In a digital timer as set forth in claim 1, said shaft means comprising a single shaft carrying said drums in side-by-side relation.

3. In a digital timer as set forth in claim 1, said drive means of said one drum comprising ring gear means carried by said one drum and disposed in meshing relation with said pinion gear means.

4. In a digital timer as set forth in claim 1, said timer means comprising another shaft means and another pair of indicator drums rotatably mounted to said frame means by said other shaft means whereby another setting means of said timer can set a selected period of time for said other pair of drums so that said drive means will drive said other pair of drums for only said period of time therefor.

5. In a digital timer as set forth in claim 4, said other shaft means comprising a single shaft carrying said other pair of drums in side-by-side relation.

6. In a digital timer as set forth in claim 4, one of said drums of one of said pairs thereof indicating minutes from zero to nine in increments of ones and the other drum thereof indicating increments of hours in increments of ones and tens of minutes in increments of tens.

7. In a digital timer as set forth in claim 4, one of said drums of one of said pairs thereof indicating minutes from zero to fifty-five in increments of five minutes and the other drum thereof indicating increments of hours in increments of ones.

8. In a digital timer as set forth in claim 4, said two pairs of drums being substantially identical in construction.

* * * * *